US005608195A

United States Patent [19]

DeMotte

[11] Patent Number: 5,608,195

[45] Date of Patent: Mar. 4, 1997

[54] PORTABLE THREE-WAY LIGHT BULB-SOCKET INSERTABLE SWITCH CONVERTER

[76] Inventor: Frank E. DeMotte, 18 Blue Mill Rd., Morristown, N.J. 07960

[21] Appl. No.: 435,542

[22] Filed: May 5, 1995

[51] Int. Cl.[6] ..... H01H 9/00; H01H 1/00; H01R 25/00

[52] U.S. Cl. ..... 200/50.28; 439/638

[58] Field of Search ..... 313/51, 122, 236; 439/160, 168, 170, 220, 602, 614, 868, 883, 890, 638–641; 200/51 R, 51.03–51.09, 51.12, 51.13, 50.28–50.32

[56] References Cited

U.S. PATENT DOCUMENTS

| | | | |
|---|---|---|---|
| 1,187,723 | 6/1916 | George | 439/667 |
| 2,788,504 | 4/1957 | Hertel | 439/168 |
| 4,104,565 | 8/1978 | Klassen | 315/178 |
| 4,342,977 | 8/1982 | McGalliard | 337/4 |
| 4,842,556 | 6/1989 | Vogel | 439/638 |
| 5,113,044 | 5/1992 | Tomberlin | 200/51.04 |

*Primary Examiner*—J. R. Scott
*Attorney, Agent, or Firm*—William T. Hough

[57] ABSTRACT

In a preferred embodiment, a disk-shaped wafer insertable into a three-way bulb-socket, thereby becomes an insertable and removable switch converter-device to convert a three-way socket to a one-way bulb-socket and/or back-to a three-way bulb-socket, includes an annular insulation ring and mounted on an upper radially inward face portion of the annular insulation ring, is located an electrically conductive disk having a raised central portion and having opposite upper and lower surfaces thereof. The lower radially outward conductive disk surface is contactable with a bottom-of-socket radially-outward electrical contact of the three-way bulb-socket. The upper conductive disk surface at the raised or electrically-insulated central portion is contactable with a three-way light bulb's role socket insertable member's lower-end bulb's two electrical contacts, one central, the other a concentric ring. The central portion's lower surface is sufficiently raised or otherwise insulated against electrical contact with the socket's central electrically-conductive contact. In another embodiment devoid of the raised central portion, a lower mounted central insulation disk insulates the central conductive portion from inoperatively contacting other electricity-conductive socket structure. Other perferred embodiments include disk-handled structures for lifting the switch converter device from a socket space, and in another embodiment, a magnetic handled structure for attracting, attaching to and removing the switch converter device from a socket space.

12 Claims, 3 Drawing Sheets

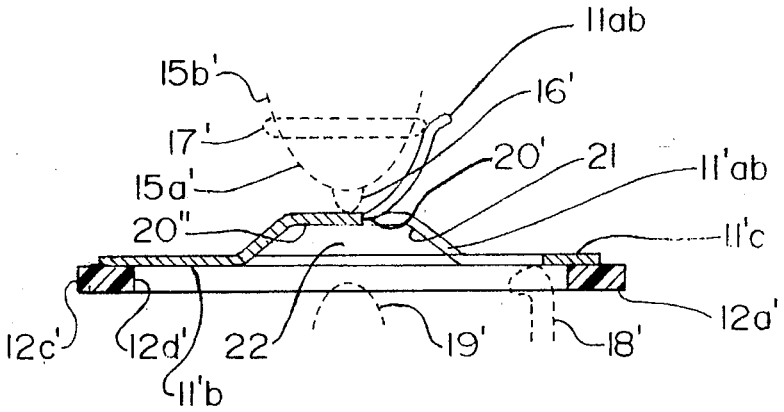
FIG. 5
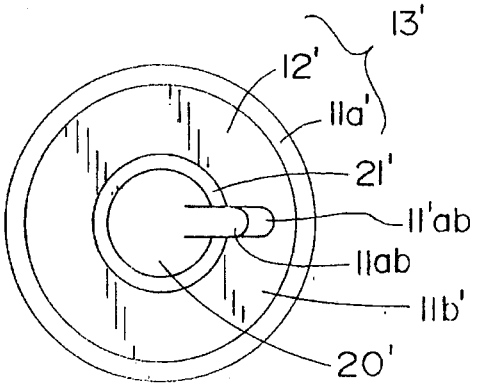
FIG. 6
FIG. 7
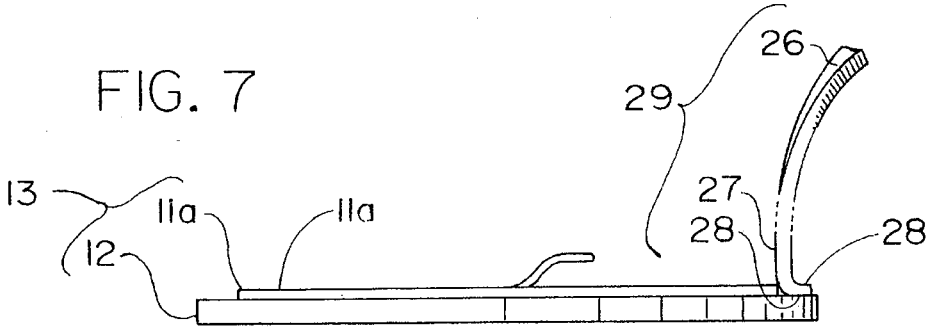

PORTABLE THREE-WAY LIGHT BULB-SOCKET INSERTABLE SWITCH CONVERTER

SPECIFICATION

This invention relates to a portable insertable switch which when inserted into a three-way bulb-socket converts the socket into a one-way socket receivable of either a one-way bulb or a three-way bulb and to selectively power a single filament or two filaments in parallel in alternate off-on sequence.

PRIOR ART

While a patentability search was conducted in Class 313, subclasses 51, 236, and 122 thereof, and in Class 439, subclasses 168, 220, 614, 170, 602, 868, 883, 890, and 160 thereof, no relevant prior art was located. Prior art of mere interest includes U.S. Pat. No. 5,113,044 to Tomberlin, as follows.

Tomberlin patent is directed to a screw-in socket, itself having a bulb-like base for screwing into a three-way socket and providing a switch selector for switching from a standard three-way light bulb on-off sequence to a one-way on/off sequence and vice-versa.

BACKGROUND

Two-filament light bulbs designed for three-way sockets provide the conventional "spot" center contact at the base of the bulb for one filament and another contact for the second filament, presently a "ring" centered on the "spot" center contact. Conventional three-way sockets provide the proper switching sequence to the spot and ring contactors of the two-filament bulbs to provide the option of any of three light intensities, one filament alone (low intensity), the other filament alone (higher intensity), or both filaments concurrently (maximum intensity).

Often the option of three intensities (low, medium, high) is of no advantage, but four turns of the three-way socket switch required each time the bulb is lighted and turned off, is inconvenient and a nuisance when only a single intensity is desired. In such cases, it is common for a user to replace the three-way bulb with a predominently desired intensity single-filament bulb, connected through the centered spot contact on its base, but four turns of the switch handle are still required from "off" to "off" (off-off-on-on-off).

Two-filament bulbs designed for three-way sockets provide the conventional "spot" center contact at the base of the bulb for the aforenoted one high-intensity filament and another contact for the aforenoted low-intensity filament, presently a "ring" centered on the "spot" center contact. Conventional three-way sockets provide the proper switching sequence to the spot and ring contactors of the two-filament bulb's aforenoted low intensity filament, the high intensity filament, or both filaments concurrently for (maximum intensity).

Note that three-way socket switches connect power to the radially outward socket contact (the ring contactor) and next to the center socket contactor (the spot) and finally to both socket contactors. Applicant has recognized that, with the existing switching sequence described above, for any filaments connected to the ring contactor (radially outward contactor of conventional three-way sockets) the desired "off"-"on"-"off"-"on" lighting switching sequence is achieved.

In other words, if in a conventional three-way socket, the "spot" contactor can be isolated and a single-filament bulb or one or both of the filaments of the three-way bulb can be connected to the radially outward "stub" contactor exclusively, the light switching sequence will be "off"-"on"-"off"-"on".

OBJECTS OF THE INVENTION

Accordingly, objects of the present invention include the obtaining of a simple portable device insertable into a female-socket cavity of a three-way socket designed for a two-filament three-way bulb (or equivalent fluorescent or gaseous-discharge (neon, mercury vapor, etc.) other two-way lighting-element device), such that when inserted, an insertable lightable fixture may thereafter be mounted in a female socket to thereby convert for use of any of a single filament of a single filament bulb or for a three-way two filament bulb, while concurrently retaining the same sequential consecutive off-on sequence aforestated, with continuous alternating from off to on and back to off, and back to on, etc.

Another object is to obtain a device of small and non-cumbersome size and shape, easily and readily insertable (and retrievable) into a three-way socket prior to and followed by insertion of a one-way or three-way bulb.

Another object is to construct such a device which securely avoids a short-circuit during the insertion, use and/or withdrawal of the device of aforestated object(s).

Another object is to achieve one or more prior objects, together with enabling non-hazardous insertion and removal of the device of aforestated. objects.

Other objects become apparent from preceding and following disclosure.

BROAD DESCRIPTION OF THE INVENTION

Broadly, the invention is a portable three-way bulb socket insertable-switch that includes converter device:

1: spaced-apart interconnected solid electrical insulation elements; and

2: at least one electrical conductor member; and

3: an electrical air or solid-filled insulation space located adjacently below a lower surface of the one or more electrical conductor members having sequentially lineally spaced-apart portions thereof; of which— a: the spaced-apart interconnected solid electrical insulation elements are spaced-apart along a linear plane and thereby form a predetermined width dimension along the linear plane, the width dimension being sufficiently long as to form a space receivable therethrough of a switch contact and b: at-least one of the spaced-apart solid electrical insulation elements have adjacent inward edges adjacently spaced-apart from one another thereof along the linear plane and having nonadjacent outward edges distantly spaced-apart from one-another thereof along the linear plane, and c: at-least one of the spaced-apart solid electrical insulation elements have a lower face extending between the adjacent inward edges and the nonadjacent outward edges, and d: at-least one of the spaced-apart solid electrical insulation elements each have at least one electrically nonconductive portion extending parallel to the linear plane serially aligned with and in contact with different ones of the nonadjacent outward edges, and e: at least one electrical conductor member has spaced-apart electrically conductive portions electrically interconnected with one-another by and includes between the spaced-apart electrically conductive portions, at least one substantially intermediate electrically conductive portion in electrically conductive contact with the spaced-apart electrically conductive portions, and f: at least one of the spaced-apart electrically conductive portions is mounted fixedly on at least one of (1) the inward edges and (2) the at least one intermediate electrically non-conductive portion and is spaced from the outer edges, and g: the substantially intermediate electrically conductive portion includes a broad portion positioned to extend broadly across a central area located substantially centrally between the spaced-apart interconnected electrical insulation elements, and h: the inward edges of the insulation and the exposed lower surface of the electrical conductor member jointly define the aforestated electrical insulation space as free space (or otherwise for receipt of electrical insulation within the free space) below the electrical conductor member and in juxtaposition to the inward edges sufficiently for an electrical light three-way bulb-socket's radially outwardly-located electricity-carrying contact to extend upwardly through the free space sufficiently to contact the electrical conductor member, and i: the broad portion includes a broad portion lower surface spaced-above the lower face and further including electrical insulation space located adjacently below the broad portion lower surface spaced-from the inward edges adjacent the free space sufficiently for an electrical light three-way bulb-socket's centrally-located socket's electrical conductor member to be electrically insulated from electrical conductive contact with the lower surface.

In a first preferred embodiment, as an improvement on the above-described broad invention, there is included additionally a central solid electricity insulation member positioned within the insulation free space and mounted on at-least one of the broad portion lower surfaces, the lower face and at-least one of the inward edges.

In a second preferred embodiment, as an improvement on the above-described broad invention, the broad portion additionally includes an upwardly extending substantially central portion extending upwardly sufficiently to enhance probability of electrically conductive contact with a light bulb's male socket-member substantially central electrical socket-contact and sufficiently to reduce probability of electrical contact of the substantially central portion with an electrical light three-way bulb-socket's centrally-located electrical conductor member when a bulb is mounted within a socket of the electrical light three-way bulb-socket.

In a third preferred embodiment as a further improvement on the second preferred embodiment, there is additionally included switch handling structure (and mechanisms thereof) for removing of the insulation elements and the electrical conductor member from an-electrical light three-way bulb-socket.

In a fourth preferred embodiment as a further improvement on the third preferred embodiment, the switch handling structure (and mechanisms thereof) includes a separate magnetic structure (and mechanisms thereof):

i) for placing the switch handling structure in a close vicinity to and safely spaced-away from an opening to an electrical light three-way bulb-socket in which the insulation elements and the electrical conductor member have been previously inserted, and ii) for magnetically attracting and withdrawal-removing the insulation elements and the electrical conductor member from an inserted state within an electrical light three-way bulb-socket.

In a fifth preferred embodiment as a further improvement on the broad invention previously described above, there is an additional improvement the same as the above-described third preferred embodiment.

In a sixth preferred embodiment as a further improvement on the fifth preferred embodiment, there is the same preferred embodiment as described above as the third preferred embodiment.

In a seventh preferred embodiment as a further improvement on the sixth preferred embodiment, the spaced-apart interconnected electrical insulation elements are in the form of a single annular disk having an upper face including the intermediate electrically nonconductive portion, and the one electrical conductor member and the spaced-apart electrically conductive portions thereof and the intermediate electrically conductive portion jointly form a circular disk mounted on the intermediate electrically non-conductive portion.

In an eighth preferred embodiment as a further improvement on the fourth preferred embodiment, the spaced-apart interconnected electrical insulation elements are formed as a single annular disk having an upper face including the intermediate electrically nonconductive portion, and in which the one electrical conductor member and the spaced-apart electrically conductive portions thereof and the intermediate electrically conductive portion jointly form a circular disk mounted on the intermediate electrically non-conductive portion.

In a ninth preferred embodiment as a further improvement on the first preferred embodiment, the further improvement is the same as the above-described eighth preferred embodiment.

In a tenth preferred embodiment which is an improvement on the above-described broad invention, the portable three-way bulb-socket insertable switch converter device includes structural features found in the eighth preferred embodiment.

In an eleventh preferred embodiment of the above broad invention, the electrical conductor member includes a three-way ring contactor element positioned to make contact with additionally a three-way bulb's ring contact. Thereby both filaments of a three-way bulb are concurrently contactable such that both filaments, to the extent that either or both is or are still operable, may be lighted concurrently when electricity is caused to flow through the electrical member. Likewise, at least one remaining operative filament of a partially burn-out three-way bulb may be lighted when the electricity is caused to flow through the electrical member.

The invention may be better understood by making reference to the drawings of the following figures.

BRIEF DESCRIPTION OF THE DRAWINGS

FIG. 5 symbolically and diagrammatically illustrates a side cross-sectional view of the FIG. 4 embodiment.

FIG. 6 symbolically and diagrammatically illustrates a top plan view of the annular disk embodiment of FIGS. 4 and 5.

FIG. 7 symbolically and diagrammatically illustrates a side view of the disk of FIG. 1, as modified in combination to include a disk removal structure.

DETAILED DESCRIPTION

Figure 1:
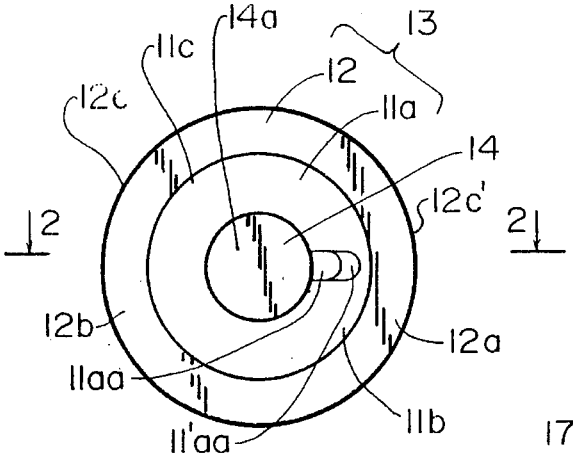
FIG. 1 symbolically and diagrammatically illustrates a bottom plan view of an annular disk embodiment of this invention, previously broadly described above.

In the present operation of a three-way bulb in a three-way socket, connection sequence of the rotary switch in the socket is as follow:

| Switch Position | Lighting | Connection of power at bulb |
|---|---|---|
| 1 | OFF | None |
| 2 | ON(Low) | Ring contact (low wattage) |
| 3 | ON(Medium) | Spot contact (high wattage) |
| 4 | ON | Both ring and spot |
| 1 | OFF | None |
| 2 | REPEAT | |

If (a) the three-way bulb is replaced by a one-way (single filament) bulb, (b) the spot contact of the bulb is isolated from the center (spot) contactor of the three-way socket, and (c) electrical contact is arranged between the radially outward three-way socket contactor to the spot contact of the single filament bulb, the resulting switching sequence of the single filament bulb will be:

| Switch Position | Lighting | Connection of power at bulb |
|---|---|---|
| 1 | OFF | None |
| 2 | ON | Spot contact (bulb wattage) |
| 3 | OFF | Socket Spot Contactor is isolated |
| 4 | ON | Spot contact (bulb wattage) |

The result is the off-on-off-on-off-on-off sequence expected of single filament bulbs. If it is desired to use a two-filament bulb (such as the replaced three-way bulb) as a one-filament bulb using the spot contact (the high wattage filament), by expanding the "arranged contact" of (c) above to include the ring contact of the three-way bulb, both filaments will be lighted in switch positions 2 and 4. The "arranged contact" is accomplished by the inventive portable three-way bulb-socket insertable switch converter device, achieving particular ones of preceding objects for the broadly-stated invention.

In greater detail as to the inventive portable three-way bulb socket insertable switch converter-device, a normally preferred "circular" electrically conducting disk having an outer circumscribing non-conducting insulation material with an edge normally horizontally-extending width as to prevent a potential electrical short circuit between the disk and the radially-outwardly positioned portions of the electrically-conductive threaded socket. Likewise, the non-conductive material of the disk does not extend so-far inwardly as to cover the three-way-switch socket's radially-outward second contactor, which is functional for contacting the (low-wattage) first filament outer radial "ring" contact of the two-filament 3-way bulb. There is also structure and mechanism/function thereof which prevents the socket's central (second filament) contact from contacting (from making/completing) the electrical circuit, such that when the disk is positioned into the three-way socket and a single-filament bulb or a two-filament (three-way) bulb is inserted into the socket and screwed down sufficiently for its "spot" contactor to contact the remaining non-masked conductive metal of the disk, electrical contact is made "solely" between the 3-way switch socket's outward switch "ring" contactor—with the result that, thereafter, the remaining filament (high-wattage) of the 3-way bulb or filament of the one-filament bulb will be turned-on by the first turn of the 3-way switch when one click (position 2) occurs. The second turn-click (position 3) will turn off the light because the second turn connects the 3-way socket's center "spot" contactor has been isolated by insulation. The third turn-click (position 4) will again turn on the light because both 3-way bulb contactors are connected. In the fourth turn-click (position 1) the light will be activated. Every other turn or click-turn constitutes a switch "on" position and therebetween, every other turn or click-turn constitutes a switch "off" position. This switching sequence occurs because the 3-way socket's central electrical contact is isolated by the insulation from electrical contact or from completion of electricity-flowing contact with the conductive portion of the aforestated electrically conductive disk structure. The upper surface of the electrically conductive structure is concurrently in contact with the central bulb contact of either a three-way bulb or of a one-filament one-contact bulb. Thereby, by use of the present portable three-way bulb-socket insertable switch converter device within the socket of a three-way socket, for either a two-filament three-way bulb or a single-filament bulb, the desired serially reoccuring "ON"-OFF" switching sequence as described, is achieved.

With reference to the foregoing, FIGS. 1, 2, 3, 7 and 8 illustrate one common embodiment embodying various preferred embodiment features, and FIGS. 4, 5, 6,9 and 10 illustrate a second common embodiment embodying various preferred embodiment features.

More particularly, FIG. 1 symbolically and diagrammatically illustrates a bottom plan view of an annular disk 13 embodiment of this invention inclusive of the annular electrical insulation member 12, previously broadly described above. There is also illustrated a lower face 11*b* of electrically conductive copper disk 11*a*, and the annular insulation member encompassing inclusive of the spaced-apart interconnected electrical solid insulation elements 12*a* and 12*b* of an annular insulation member 12. Also illustrated is the electrically non-conductive preferred solid electrical insulation member 14 shown in disk shape.

Figure 2:
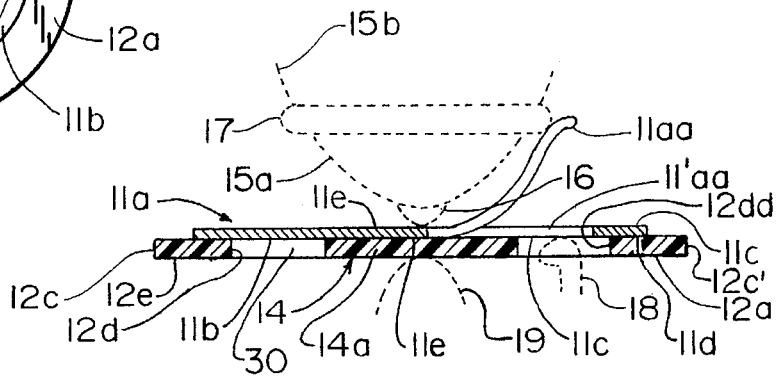
FIG. 2 symbolically and diagrammatically illustrates a side cross-sectional view of the FIG. 1 embodiment.

FIG. 2 symbolically and diagrammatically illustrates a side cross-sectional view of the FIG. 1 embodiment, also illustrating the relative typical functioning position of the prior art three-way lower bulb-base portion 15*a* with its "spot" contact 16 and its higher-up ring contact 17 located below the upper bulb-base portion 15*b*. Additionally, the relative typical functioning positions of each and both the three-way socket's outwardly-spaced ring-contact 18 and the central three-way socket's spot-contact 19 are shown. Also illustrated are the outer and inner edges 12*d* and 12*dd* of the electrical insulation member 12.

FIGS. 1 and 2, taken together, include elements found in the generic invention; namely, a portable three-way bulb-socket insertable switch converter device.

The switch converter-device broadly includes at least the following elements. There are shown spaced apart interconnected electrical solid insulation elements spaced apart along a linear plane. The spaced apart interconnected electrical solid insulation elements have a predetermined width dimension along the linear plane of which the width dimension is receivable within an electrical socket.

Each of the spaced apart electrical solid insulation elements additionally include adjacent inward edges 12*d* and 12*dd* adjacently spaced apart from one another thereof along the linear plane and nonadjacent outward edges 12*c* and 12*e* distantly spaced apart from one another thereof along the linear plane.

At least one electrically nonconductive portion extends parallel to the linear plane serially aligned with and in contact with different ones of the nonadjacent outward edges 12*c* and 12*c*'.

At least one electrical conductor member 11*a* has spaced apart electrically conductive portions 11*b* and 11*c* electrically interconnected with one another by, and including therebetween, at least one substantially intermediate electrically conductive portion 11*e* in electrically conductive contact with the spaced apart electrically conductive portions 11*b* and 11*c*.

At least one of the spaced apart electrically conductive portions (11*b* and 11*c*) is mounted fixedly on at least one of the adjacent inward edges 12*d* and 12*dd*. The spaced apart electrically conductive potion(s) 12*b* and/or 11*c* is spaced from the outer edges 12*c* and/or 12*c*'.

The above-noted substantially intermediate electrically conductive portion 11*e* includes a broad potion that extends across a central area located substantially centrally between the spaced apart interconnected electrical solid insulation elements 12*a* and 12*b*. The above noted adjacent inward edges 12*d* and/or 12*dd* and the electrical conductor member 11*a* jointly define free space 30 positioned below the electrical conductor member 11*a* and in juxtaposition to the adjacent inward edges 12*d* and 12*dd*. The free space is of a size sufficient for an electrical light three-way bulb-socket's radially outwardly-located socket's electricity-carrying contactor 18, to extend upwardly through the free space 30 sufficiently to contact the electrical conductor member 11*a*.

The above-noted broad portion includes a conductive broad lower surface 11*d* spaced above the lower face 12*a* and 12*e*. The broad portion further include electrical insulation free space 30 located adjacently below the conductive portion lower surface 11*d* spaced from the adjacent inward edges adjacent the free space 30 sufficiently for an electrical light three-way bulb-socket's centrally-located socket's electrical conductor member to be electrically insulated from electrical conductive contact with a lower surface.

FIGS. 1 and 2 likewise each illustrate a preferred embodiment that includes the solid electricity insulation disk 14 positioned within the free space 30, anchored typically to the broad lower surface 11*e* of the electrical conductor member 11*a*.

Figure 3:
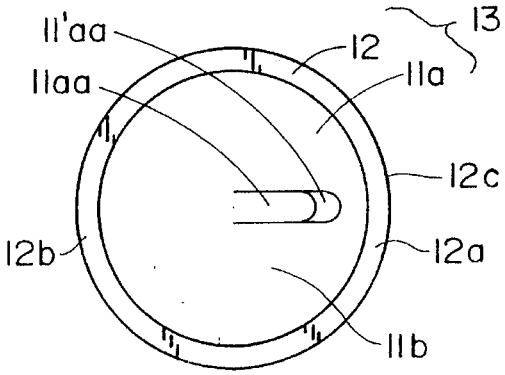
FIG. 3 symbolically and diagrammatically illustrates a top plan view of the annular disk embodiment of FIGS. 1 and 2.

FIG. 3 symbolically and diagrammatically illustrates a top plan view of the annular disk embodiment of FIGS. 1 and 2, illustrating the top view.

Figure 4:
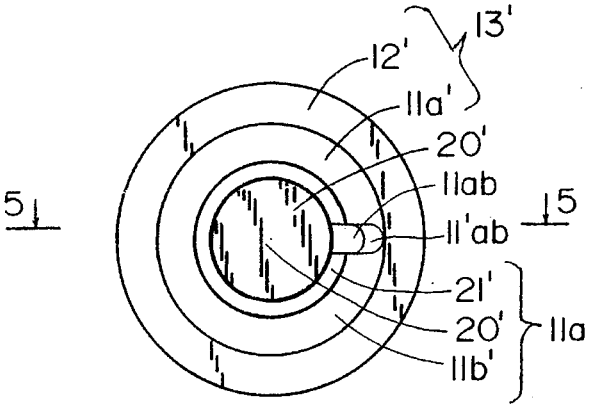
FIG. 4 symbolically and diagrammatically illustrates a bottom plan view of an alternate disk embodiment of this invention, previously broadly described above.

FIG. 4 symbolically and diagrammatically illustrates a bottom plan view of an alternate disk embodiment 13' of this invention, previously broadly described above. The disk embodiment 13' includes the annular insulation member 12' and modified disk 11*a*', showing a bottom face of the elevated central disk portion 20', with the slanted (angular) portion 21 and the outer-part of the electrically conductive disk lower face 11*b*', elevated angular portion 21, 11*b*' and 20' jointly making up the disk 11*a*, and elevated underface 20" of the elevated central disk portion 20'.

FIG. 5 symbolically and diagrammatically illustrates a side cross-sectional view of the FIG. 4 embodiment. Also illustrating the relative typical functioning position of the prior art three-way lower bulb-base portion 15*a*' with its "spot" contact 16' and its higher-up ring contact 17' below the upper bulb-base portion 15*b*', and also showing the relative typical functioning positions of each and both the three-way socket's outwardly-spaced ring-contact 18' and the central three-way socket's spot-contact 19', and the outer edge 12*c*' and inner edge 12*d*' of the electrical insulation member 12'. Also illustrated is the aforenoted elevated central disk portion 20', the angular portion 21, and the large space 22 below the elevated underface 20".

FIG. 5 illustrates another preferred embodiment having (as a part of the above described broad portion) an upwardly extending substantially central, portion. This central portion extends upwardly sufficiently to enhance positive engagement of the electrically conductive contact with a light bulb's male socket-base's member substantially central electrical socket-contact. Likewise, the improved part of the central portion sufficiently reduces positive engagement of electrical contact of the substantially central portion with an electrical light three-way bulb-socket's centrally-located electrical conductor member, when a bulb is mounted within a socket of an electrical light three-way bulb-socket.

FIG. 6 symbolically and diagrammatically illustrates a top plan view of the annular disk embodiment of FIGS. 4 and 5.

FIGS. 7 through 10 each illustrate a handle structure mounted on an upper outer edge of the insulation disk and a mechanism for grasping and removing the switch converter device from the interior region of a light socket.

FIG. 7 symbolically and diagrammatically illustrates a side view of the disk of FIG. 1, as modified in combination to include disk removal flattened elongated structure(s) 29 that includes an elongated central portion and upper grasping flattened end 26 and a lower disk-attachment end 28 anchored adhesively or otherwise to the angular electrical insulation member 12.

Figure 8:
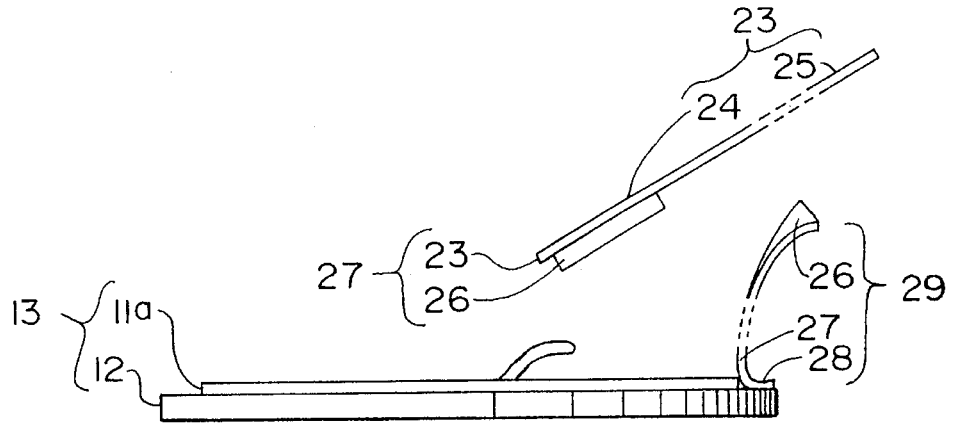
FIG. 8 symbolically and diagrammatically illustrates a side view of the disk of FIG. 1 as alternately modified in combination to include a disk removal structure.
Figure 10:
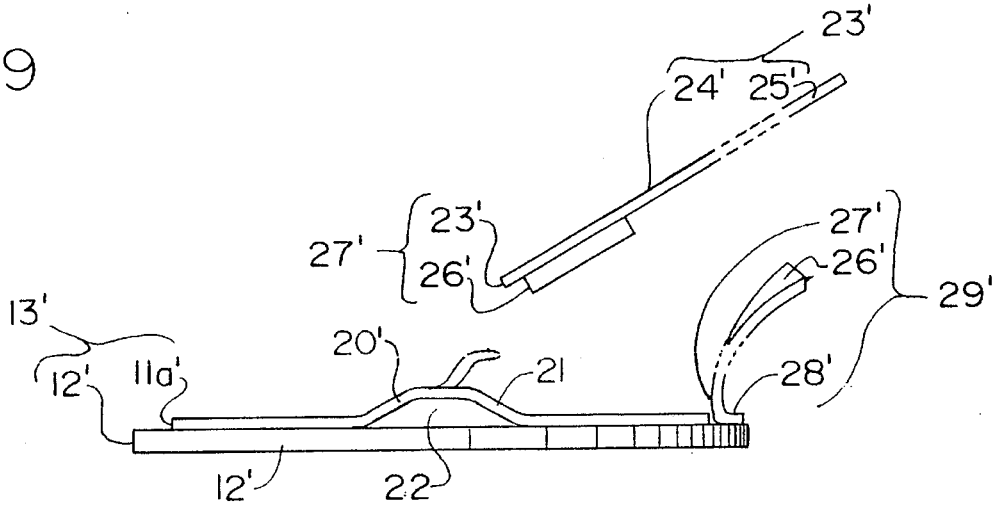
FIG. 10 symbolically and diagrammatically illustrates a side view of the disk of FIG. 4 as alternately modified in combination to include a disk removal structure.

FIGS. 8 and 10 each illustrate a preferred embodiment directed to a magnetic handled device for magnetically attracting to and removal of the switch converter-device from a socket-inserted state and position.

FIG. 8 symbolically and diagrammatically illustrates a side view of the disk of FIG. 1 as alternately modified in combination to include a disk removal structure. In addition to the features illustrated in FIG. 7, this FIG. 8 additionally illustrates a magnetic instrument including a handle 23 and a magnetic element 26 for operational use outside of a socket, with sufficient magnetic attraction to attract and thereby withdraw a magnetizable annular disk 13. The handle 23 has the grasping end 25 and the magnet-mounting end 24.

Figure 9:
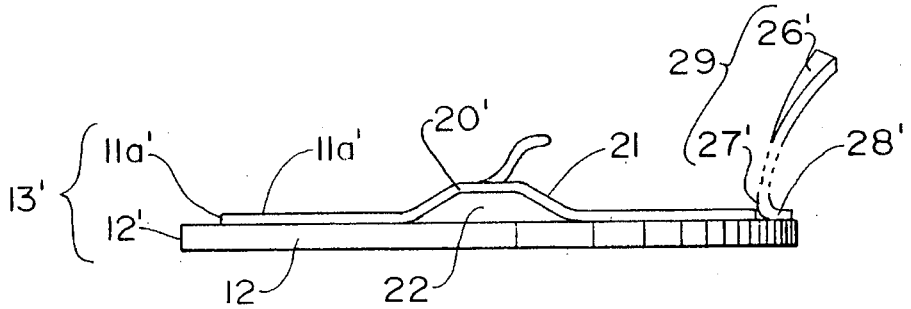
FIG. 9 symbolically and diagrammatically illustrates a side view of the disk of FIG. 4, as modified in combination to include a disk removal structure.

FIG. 9 symbolically and diagrammatically illustrates a side view of the disk of FIG. 4, as modified in combination to include a disk removal structure. For this FIG. 9 embodiment, the same features are illustrated as for FIG. 7.

FIG. 10 symbolically and diagrammatically illustrates a side view of the disk of FIG. 4 as alternately modified in combination to include a disk removal structure. For this FIG. 10 embodiment, the same features are illustrated in FIG. 8.

In the eleventh preferred embodiment, the electrical conductor member, which is electrically, conductive copper disk 11*a*, includes a three-way ring contactor element 11*aa* illustrated in FIGS. 1 through 3 or three way ring contactor element 11*ab* of FIGS. 4 through 6, positioned to make contact with additionally a three-way bulb ring contact 17 of FIG. 2 or 17' three way bulb ring contact of FIG. 5. Thereby both conventional separate filaments of a three-way bulb are concurrently contactable such that both filaments (to the extent that either or both is or are still operable) may be lighted concurrently when electricity is caused to flow through the electrical conductor member. Likewise, a remaining operative filament of a partially burn-out three-way bulb maybe lighted when the electricity flows through the electrical conductor member. In the illustrations of FIGS. 1 through 3 the three-way ring contactor element 11*aa* is a partial cut-out elongated flexibly-biased strip leaving cut-out space 11*aa*. Likewise, in the illustrations of FIGS. 4 through 6 the three-way ring contactor element 11*ab* is a partial cut-out elongated flexibly-biased strip leaving cut-out space 11'*ab*. In the illustrations of FIGS. 2 and 5, the three-way ring contactor 11*aa* or 11*ab* is shown biased against the higher-up ring contact 17 in FIG. 2 and ring contact 17 in FIG. 5.

It is within the scope of the invention to make substitution of equivalents, and/or modification(s) and variation(s) with ordinary skill of an ordinary artisan.

I claim:

1. A portable three-way bulb-socket insertable switch converter-device comprising in combination: spaced-apart interconnected electrical solid insulation elements spaced-apart along a linear plane and having a predetermined width dimension along said linear plane of which the width dimension is receivable within an electrical socket, each of the spaced-apart electrical solid insulation elements:

(a) having, adjacent inward edges adjacently spaced-apart from one another thereof along said linear plane and (b) having nonadjacent outward edges distantly spaced-apart from one-another thereof along said linear plane and (c) having a lower face extending between said adjacent inward edges and said nonadjacent outward edges, and the spaced-apart electrical solid insulation elements each having at least one electrically nonconductive portion extending parallel to said linear plane serially aligned with and in contact with different ones of the nonadjacent outward edges, and at least one electrical conductor member having spaced apart electrically conductive portions electrically interconnected with one another by and including-therebetween at least one substantially intermediate electrically conductive portion in electrically conductive contact with said spaced-apart electrically conductive portions, at least one of the spaced-apart electrically conductive portions:

(a) mounted fixedly on at least one of said adjacent inward edges and (b) spaced from said outer edges, said substantially intermediate electrically conductive portion including a broad portion extending across a central area located substantially centrally between said spaced-apart interconnected electrical solid insulation elements, said adjacent inward edges and said electrical conductor member jointly defining electrical insulation free space below said electrical conductor member and in juxtaposition to said adjacent inward edges sufficient for an electrical light three-way bulb-socket's radially outwardly-located socket's electricity-carrying contactor to extend upwardly through said free-space sufficiently to contact said electrical conductor member, said broad portion including a conductive broad lower surface spaced-above said lower face and further including electrical insulation space located adjacently below said conductive broad lower surface spaced-from said adjacent inward edges adjacent said free space sufficiently for an electrical light three-way bulb-socket's centrally-located socket's electrical conductor member to be electrically insulated from electrical conductive contact with a said lower surface.

2. The portable three-way bulb-socket insertable switch converter-device of claim 1, including a broad lower surface and including a central electricity insulation member positioned within said free space and mounted on said broad lower surface of the conductive member.

3. The portable three-way bulb-socket insertable switch converter-device of claim 1, in which said broad portion includes an upwardly extending, substantially central portion extending upwardly sufficiently to enhance positive engagement of said electrically conductive contact with a light bulb's male socket-base's member substantially central electrical socket-contact and sufficiently to reduce positive engagement of electrical contact of the substantially central portion with an electrical light three-way bulb-socket's centrally-located electrical conductor member when a bulb is mounted within a socket of an electrical light three-way bulb-socket.

4. The portable three-way bulb-socket insertable switch converter-device of claim 3, including switch converter-device handling means for removing said insulation elements and said electrical conductor member from an electrical light three-way bulb-socket.

5. The portable three-way bulb-socket insertable switch converter-device of claim 4, in which said switch converter-device handling means comprises a separate magnetic means for placing in a close vicinity to and spaced-away from an opening to an electrical light three-way bulb-socket in which said insulation elements and said electrical conductor member have been previously inserted, and for magnetically attracting and removing said insulation elements and said electrical conductor member from an inserted state within an electrical light three-way bulb-socket.

6. The portable three-way bulb-socket insertable switch converter-device of claim 1, including switch converter-device handling means for removing of said insulation elements and said electrical conductor member from an electrical light three-way bulb-socket.

7. The portable three-way bulb-socket insertable switch converter-device of claim 6, in which said switch converter-device handling means comprises a separate magnetic means for placing in a close vicinity to and spaced-away from an opening to an electrical light three-way bulb-socket in which said insulation elements and said electrical conductor member have been previously inserted, and for magnetically attracting and removing said insulation elements and said electrical conductor member from an inserted state within an electrical light three-way bulb-socket.

8. The portable three-way bulb-socket insertable switch converter-device of claim 7, in which said spaced-apart interconnected electrical solid insulation elements are in the form of a single annular disk having an upper face including said intermediate electrically nonconductive portion, and in which said one electrical conductor member and the spaced-apart electrically conductive portions thereof and the intermediate electrically conductive portion jointly form a circular disk mounted on said intermediate electrically nonconductive portion.

9. The portable three-way bulb-socket insertable switch converter-device of claim 5, in which said spaced-apart interconnected electrical solid insulation elements are in the form of a single annular disk having an upper face including said intermediate electrically nonconductive portion, and in which said one electrical conductor member and the spaced-apart electrically conductive portions thereof and the intermediate electrically conductive portion jointly form a circular disk mounted on said intermediate electrically nonconductive portion.

10. The portable three-way bulb-socket insertable switch of converter-device claim 2, in which said spaced-apart interconnected electrical solid insulation elements are in the form of a single annular disk having an upper face including said intermediate electrically nonconductive portion, and in which said one electrical conductor member and the spaced-apart electrically conductive portions thereof and the intermediate electrically conductive portion jointly form a circular disk mounted on said intermediate electrically nonconductive portion.

11. The portable three-way bulb-socket insertable switch converter-device of claim 1, in which said spaced-apart interconnected electrical solid insulation elements are in the form of a single annular disk having an upper face including said intermediate electrically nonconductive portion, and in which said one electrical conductor member and the spaced-apart electrically conductive portions thereof and the intermediate electrically conductive portion jointly form a circular disk mounted on said intermediate electrically nonconductive portion.

12. The portable three-way bulb-socket insertable switch converter-device of claim 1, in which said electrical conductive member includes a three-way bulb ring contactor element positioned to make contact with a three-way bulb ring contact, such that concurrently both filaments of a three-way bulb are concurrently contactable whereby both filaments thereof are lighted when electricity is caused to flow through said electrical conductive member.

* * * * *